US010316604B2

(12) United States Patent
Naedler et al.

(10) Patent No.: US 10,316,604 B2
(45) Date of Patent: Jun. 11, 2019

(54) INFLATABLE SEAL WITH FABRIC EXPANSION RESTRICTION

(71) Applicant: UTEX INDUSTRIES, INC., Houston, TX (US)

(72) Inventors: Mark Henry Naedler, Jonestown, TX (US); Brett Thomas Sheely, Sugar Land, TX (US); Timothy Vincent Burns, Shavertown, PA (US)

(73) Assignee: UTEX Industries, Inc., Houston, TX (US)

( * ) Notice: Subject to any disclaimer, the term of this patent is extended or adjusted under 35 U.S.C. 154(b) by 0 days.

(21) Appl. No.: 14/790,752

(22) Filed: Jul. 2, 2015

(65) Prior Publication Data

US 2016/0002995 A1 Jan. 7, 2016

Related U.S. Application Data

(60) Provisional application No. 62/020,263, filed on Jul. 2, 2014.

(51) Int. Cl.
*E21B 33/035* (2006.01)
*E21B 33/00* (2006.01)

(52) U.S. Cl.
CPC ..... *E21B 33/035* (2013.01); *E21B 2033/005* (2013.01)

(58) Field of Classification Search
CPC ..... F16J 15/166
See application file for complete search history.

(56) References Cited

U.S. PATENT DOCUMENTS 2,527,088 A * 10/1950 Young ..... F16J 15/20 277/534
2,720,011 A * 10/1955 Krupp ..... B64D 15/02 277/646
2,731,282 A * 1/1956 McManus ..... F16J 15/46 277/513
2,765,204 A * 10/1956 Josephson ..... F16J 15/32 277/468
2,808,301 A * 10/1957 Bowerman ..... F04B 53/143 277/437
2,918,336 A * 12/1959 Slough ..... F04B 53/143 277/437
3,095,619 A * 7/1963 Peterson ..... B22C 7/062 277/316
3,271,038 A * 9/1966 Bastow ..... F16J 15/166 277/562

(Continued)

*Primary Examiner* — Vishal A Patel
*Assistant Examiner* — L. Susmitha Koneru
(74) *Attorney, Agent, or Firm* — Haynes and Boone, LLP

(57) ABSTRACT

A diverter flowline seal assembly for use in subsea drilling. The seal assembly includes a seal body having an inner diameter end and an outer diameter end formed of an inflatable elastomeric material having a first modulus. The inner diameter end of the seal body includes two diametrically opposed axially inward lip portions and two diametrically opposed axially outward base portions. Integrated with the inflatable elastomeric material at the base portions of the inner diameter end of the seal body is a material having a modulus that is higher than the modulus of the inflatable elastomeric material so as to prevent the radial expansion of the lip portions and the base portions of the inner diameter end of the seal body.

1 Claim, 5 Drawing Sheets

(56) References Cited

U.S. PATENT DOCUMENTS 3,473,814 A * 10/1969 Bastow ..... F16J 15/166 277/436
3,583,712 A * 6/1971 Domros ..... F16J 15/32 277/436
3,719,366 A * 3/1973 Pippert ..... F16J 15/166 277/562
3,920,252 A * 11/1975 Dechavanne ..... F16J 15/3208 277/437
3,990,712 A * 11/1976 Dechavanne ..... F16J 15/32 277/468
4,059,280 A * 11/1977 Eastwood ..... F16J 15/166 277/436
4,219,204 A * 8/1980 Pippert ..... F16J 15/166 277/530
4,310,163 A * 1/1982 Pipped ..... F16J 15/166 277/562
4,491,332 A * 1/1985 Zumbusch ..... F16J 15/322 277/558
4,516,785 A * 5/1985 Miller ..... F16J 15/166 277/487
4,576,386 A * 3/1986 Benson ..... F16J 15/166 277/584
5,163,692 A * 11/1992 Schofield ..... F16J 15/3236 277/436
5,269,537 A * 12/1993 Kiesel ..... F16J 15/3208 277/554
5,390,939 A * 2/1995 Terauchi ..... E21D 11/385 277/648
5,890,535 A * 4/1999 Petrash ..... E21B 33/03 166/120
6,029,980 A * 2/2000 Downes ..... F16J 15/322 277/552
6,290,231 B1 9/2001 Petrash et al.
8,739,684 B2 * 6/2014 Okuma ..... F16J 15/3284 92/165 R
9,127,771 B2 * 9/2015 Okuma ..... F15B 15/1452
2004/0245729 A1 * 12/2004 Bock ..... F16J 15/3284 277/569
2011/0115168 A1 * 5/2011 Miller ..... F16J 15/166 277/562
2013/0234401 A1 9/2013 Smith

* cited by examiner

INFLATABLE SEAL WITH FABRIC EXPANSION RESTRICTION

CROSS-REFERENCE TO RELATED APPLICATIONS

The present application claims the benefit of and priority to U.S. Provisional Patent Application No. 62/020,263 filed Jul. 2, 2014, which is hereby incorporated by references in its entirety.

BACKGROUND

The present invention generally relates to diverters and in particular to a diverter flowline seal used in subsea drilling.

Installing large diameter elastomeric diverter flowline seals can often be difficult since compressing a substantial amount of rubber into sealing position can require substantial force that is not always available. Also, stabbing an external piston type seal into a bore without damaging the seal or surrounding hardware is difficult when the diameters of the seal and surrounding hardware are equal to or greater than the receiving bore diameter. Unidirectional elastomeric seals such as a lip seal can be used to alleviate stabbing problems since they do not require cross-sectional compression of the elastomeric material by utilizing a lip that can easily be bent inward. However, many seal applications require bidirectional sealing and using two lip seals is not desirable since one lip seal must be stabbed in a direction that could snag the lip.

A diverter flowline seal used in subsea drilling that must be stabbed into a mating bore, is an example of a large diameter seal that is difficult to install. A common practice is to use an inflatable seal that, in its preinstalled state, has significant clearance with the mating bore, and when inflated with auxiliary fluid pressure, expands to firmly engage and seal against the bore. This type of seal is easy to install and once inflated provides bidirectional sealing.

Conventional diverter flowline seal designs rely on rigid metal end rings partitioned by a bonded elastomeric sealing element which can be slipped onto and retained on a stabbing mandrel. Elastomeric seals such as o-rings form a seal between the inner diameter of the metal rings and the exterior of the stabbing mandrel. A channel within the stabbing mandrel transmits auxiliary fluid pressure between the two end ring seals and inflates the bonded elastomeric section of the flowline seal assembly after the mandrel is stabbed into position. The inflated bonded elastomeric section expands to contact the receiving bore and a bidirectional seal is created between the diverter flowline seal and the receiving bore. An inherent weakness in this design, however, is located at the bonded boundary between the rigid metal end rings and the inflatable elastomeric section. Fatigue at this highly stressed boundary causes bond separation or tearing of the elastomeric sealing element and initiates a leak.

Another conventional diverter flowline seal design is shown in U.S. Pat. Nos. 5,890,535 and 6,290,231. The diverter flowline seal design shown in these patents eliminates the potential leakage across the bonded area between the rigid metal end rings and the inflatable elastomeric section by moving the sealing bead of the internal seals that seal off against the stabbing mandrel from the inner diameters of the metal rings to lip seals that are formed within the bonded elastomeric section. Shoulders extending from the rigid metal end rings extend over the internal lip seals and restrict expansion of the lip diameters during inflation. The contrasting material modulus at the boundaries of the rigid metal end rings and the inflatable elastomeric section, however, still creates high stress concentrations with the elastomeric section and can initiate tearing at this boundary.

DETAILED DESCRIPTION

Figure 1:
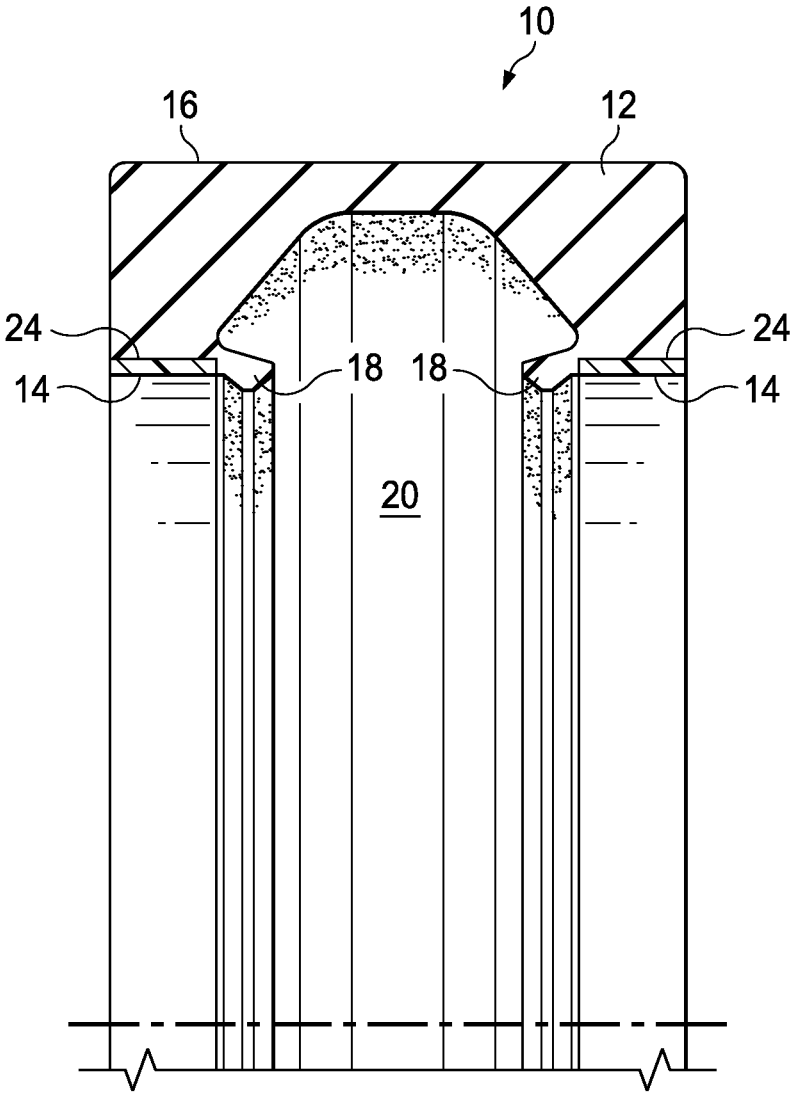
FIG. 1 is a cross-sectional view of an inflatable seal assembly.
Figure 2:
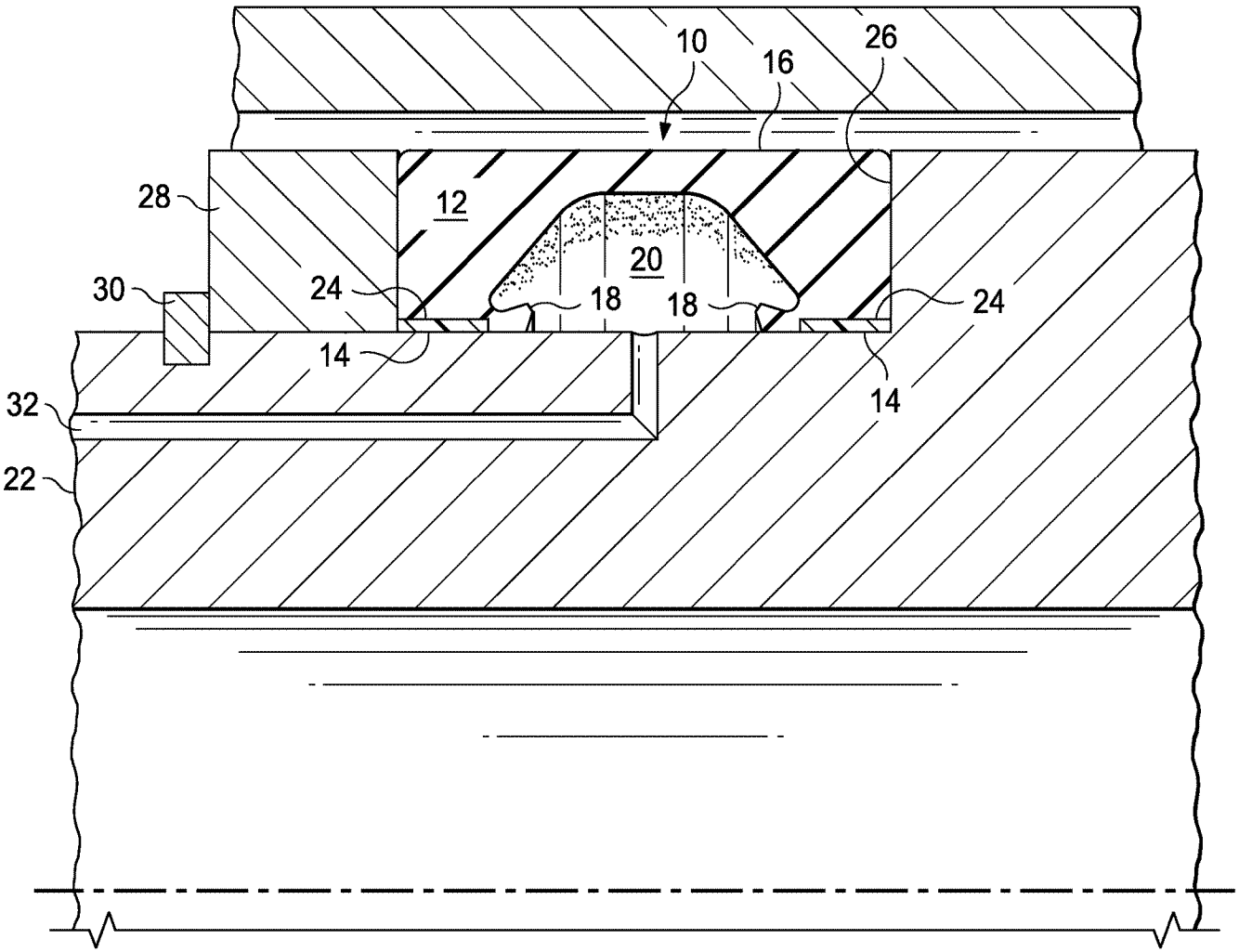
FIG. 2 is a cross-sectional view of the inflatable seal assembly of FIG. 1 installed on a stabbing mandrel.

Referring initially to FIGS. 1 and 2, a sealing ring 10 is shown which comprises a generally C-shaped elastomeric body 12 having an inner diameter side 14, and an outer diameter side 16 that form a seal and define a cavity 20 when in contact with a stabbing mandrel 22. The inner diameter side 14 includes axially inward and diametrically opposed sealing lip portions 18 located adjacent to axially outward and diametrically opposed base portions 24. One or more layers of a high modulus reinforcing material is integrally molded to the elastomeric body 12 at the base portions 24 at a position adjacent to and axially outward from the sealing lips 18 on the inner diameter side 14 of the elastomeric body 12. According to several exemplary embodiments, the high modulus reinforcing material has good bonding strength to the elastomeric body 12. According to several exemplary embodiments, the high modulus reinforcing material has a modulus that is higher than the modulus of the elastomeric material that forms the elastomeric body 12. According to several exemplary embodiments, the high modulus reinforcing material is a fabric formed from a material used in rubber molding. The term fabric as used with respect to the high modulus reinforcing material of the exemplary embodiments, is used in the broadest sense and includes any cloth or cloth-like structure made by any technique such as knitting, weaving or felting of fibers of natural or synthetic materials as well as mixed fibers and includes, without limitation, fibers of cotton, carbon, Nomex®, nylon, polyester, polyester blends, aramid (aromatic polyamide) fibers, fiberglass fibers or a metallic band or any combination thereof. According to several exemplary embodiments, the high modulus reinforcing material is wrapped in a hoop orientation which minimizes radial expansion of the high modulus reinforcing material when the inner cavity 20 of the sealing ring 10 is pressurized as will be discussed below in connection with FIG. 3. Those of ordinary skill in the art will recognize that the number of layers of high modulus reinforcing material needed to restrict radial expansion of the inner diameter side 14 of the elastomeric body 12 is related to the modulus of the high modulus reinforcing material, the modulus of the elastomeric body, the diameter of the flowline seal, and the proportions of the elastomeric body.

Figure 5:
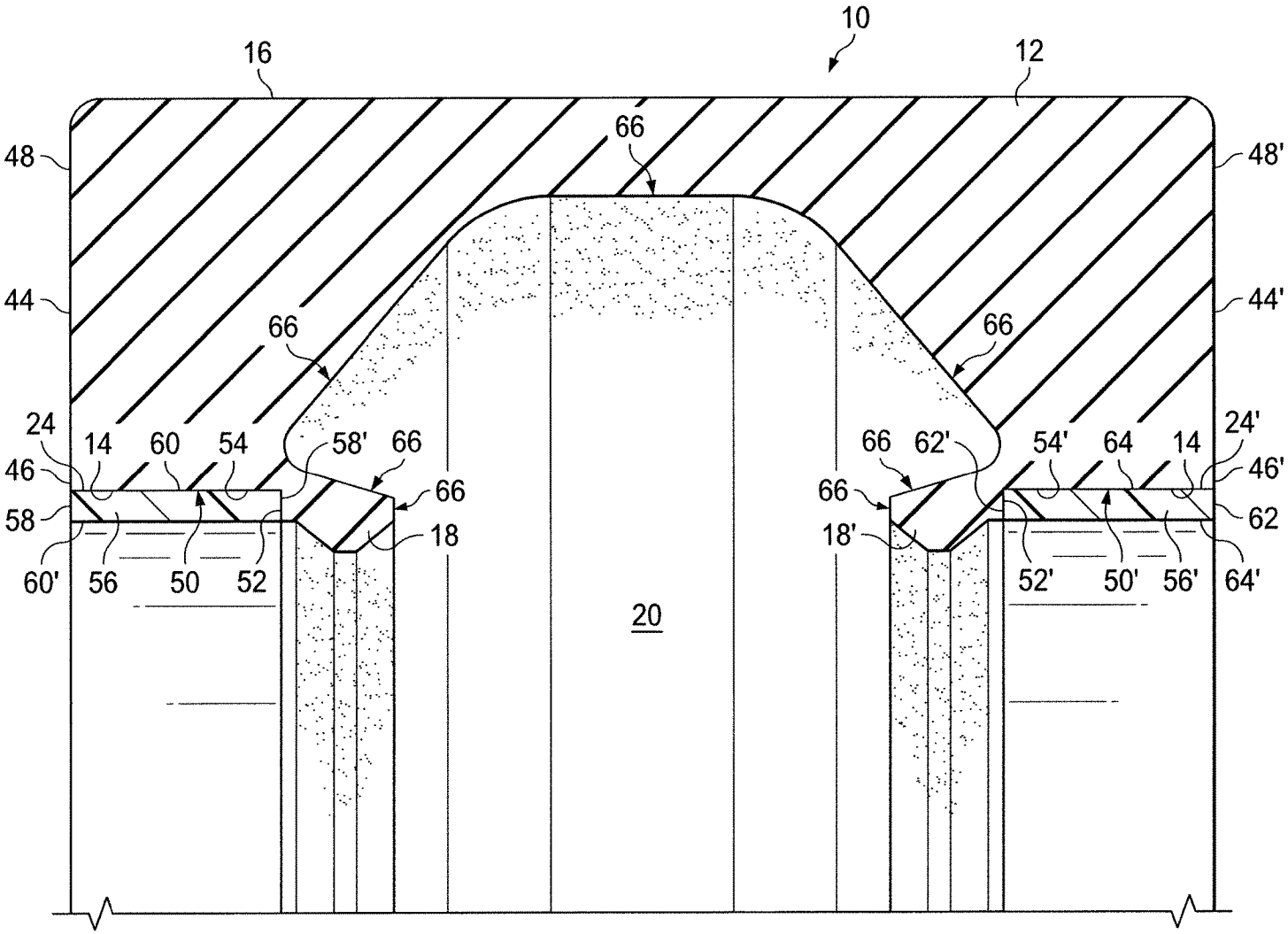
FIG. 5 is an enlarged view of a portion of FIG. 1.

Referring to FIG. 5 a sealing ring 10 is shown which includes a seal body 12 having a generally C-shaped cross section, the seal body 12 having an inner diameter end 14, an opposite outer diameter end 16, and first and second side ends 44, 44'. The seal body 12 is formed of an inflatable elastomeric material having a first modulus and the inner diameter end 14 of the seal body 12 includes diametrically opposed first and second axially inward lip portions 18, 18' and diametrically opposed first and second axially outward base portions 24, 24'. As shown in FIG. 5, the inner diameter end 14 and the outer diameter end 16 have approximately equal axial dimensions. Each of the first and second side ends 44, 44' has a first end 46, 46' adjacent a corresponding one of the base portions 24, 24' of the inner diameter end 14 of the seal body 12, and a second end 48, 48' adjacent the outer diameter end 16 of the seal body 12. The seal body 12 defines an inner region 20 into which fluid pressure is adapted to be delivered to inflate the inflatable elastomeric material having the first modulus. As depicted in FIG. 5, an interface boundary 66 is defined between the seal body 12 and the inner region 20 such that the inflatable elastomeric material having the first modulus, and the inner region 20 together define the generally C-shaped cross section of the seal body 12. Also, the inflatable elastomeric material having the first modulus extends uninterruptedly throughout the generally C-shaped cross section of the seal body 12. Accordingly, due to the uninterrupted extension of the inflatable elastomeric material throughout the generally C-shaped cross section of the seal body 12, the inflatable elastomeric material having the first modulus extends uninterruptedly along the interface boundary 66 in its entirety between the seal body 12 and the inner region 20, and thus the inflatable elastomeric material having the first modulus is adjacent the inner region 20 along the interface boundary 66 in its entirety between the seal body 12 and the inner region 20.

With continuing reference to FIG. 5, the diametrically opposed first and second axially outward base portions 24, 24' include first and second recesses 50, 50' formed in the seal body 12, and each of the first and second recesses 50, 50' define a radially-extending surface 52, 52' and an axially-extending surface 54, 54'. The first and second recesses 50, 50' are axially spaced from each other, while the radially-extending surfaces 52, 52' of the first and second recesses 50, 50' are axially spaced from each other in a parallel relation, and the axially-extending surfaces 54, 54' of the first and second recesses 50, 50' are axially spaced from each other and are coaxial with each other. The axially-extending surface 54 defined by the first recess 50 extends from the radially-extending surface 52 defined by the first recess 50 to the first end 46 of the first side end 44, and thus the axially-extending surface 54 defined by the first recess 50 is adjacent the first end 46 of the first side end 44. Also, the axially-extending surface 54' defined by the second recess 50' extends from the radially-extending surface 52' defined by the second recess 50' to the first end 46' of the second side end 44', and thus the axially-extending surface 54' defined by the second recess 50' is adjacent the first end 46' of the second side end 44'.

As shown in FIG. 5, a first layer of reinforcing material 56 having a second modulus that is higher than the first modulus is integrally molded to the seal body 12 at the first axially outward base portion 24. The first layer of reinforcing material 56 is disposed within the first recess 50 such that the first layer of reinforcing material 56 extends from the radially-extending surface 52 defined by the first recess 50 to the first end 46 of the first side end 44 of the seal body 12. The first layer of reinforcing material 56 defines first and second faces 58, 58' spaced axially and in a parallel relation and first and second surfaces 60, 60' spaced radially and in a concentric relation. Each of the first and second surfaces 60, 60' of the first layer of reinforcing material 56 extends from the first face 58 of the first layer of reinforcing material 56 to the second face 58' of the first layer of reinforcing material 56. The first face 58 defined by the first layer of reinforcing material 56 is approximately axially aligned with the first side end 44 of the seal body 12 and the second face 58' defined by the first layer of reinforcing material 56 contacts the radially-extending surface 52 defined by the first recess 50. The first surface 60 of the first layer of reinforcing material 56 contacts the axially-extending surface 54 defined by the first recess 50 and the second surface 60' of the first layer of reinforcing material 56 is radially positioned between the axially-extending surface 54 defined by the first recess 50 and at least a portion of the first axially inward lip portion 18 of the seal body 12.

As also shown in FIG. 5, a second layer of reinforcing material 56' having the second modulus is integrally molded to the seal body 12 at the second axially outward base portion 24'. The second layer of reinforcing material 56' is disposed within the second recess 50' and the second layer of reinforcing material 56' is axially spaced from the first layer of reinforcing material 56 in a parallel relation. The second layer of reinforcing material 56' extends from the radially-extending surface 52' defined by the second recess 50' to the first end 46' of the second side end 44' of the seal body 12. The second layer of reinforcing material 56' defines first and second faces 62, 62' spaced axially and in a parallel relation and first and second surfaces 64, 64' spaced radially and in a concentric relation. Each of the first and second surfaces 64, 64' of the second layer of reinforcing material 56' extends from the first face 62 of the second layer of reinforcing material 56' to the second face 62' of the second layer of reinforcing material 56'. The first face 62 defined by the second layer of reinforcing material 56' is approximately axially aligned with the second side end 44' of the seal body 12 and the second face 62' defined by the second layer of reinforcing material 56' contacts the radially-extending surface 52' defined by the second recess 50'. The first surface 64 of the second layer of reinforcing material 56' contacts the axially-extending surface 54' defined by the second recess 50' and the second surface 64' of the second layer of reinforcing material 56' is radially positioned between the axially-extending surface 54' defined by the second recess 50' and at least a portion of the second axially inward lip portion 18' of the seal body 12.

As shown in FIG. 2, the sealing ring 10 is installed on a stabbing mandrel 22 which is typically formed of steel. The stabbing mandrel 22 includes a shoulder 26 which supports the sealing ring 10 on one side and a rigid ring 28 held by a retaining ring 30 which supports the other side of the sealing ring 10. The stabbing mandrel 22 includes a passage 32 which is in fluid communication with the inner cavity 20 of the sealing ring 10.

Figure 3:
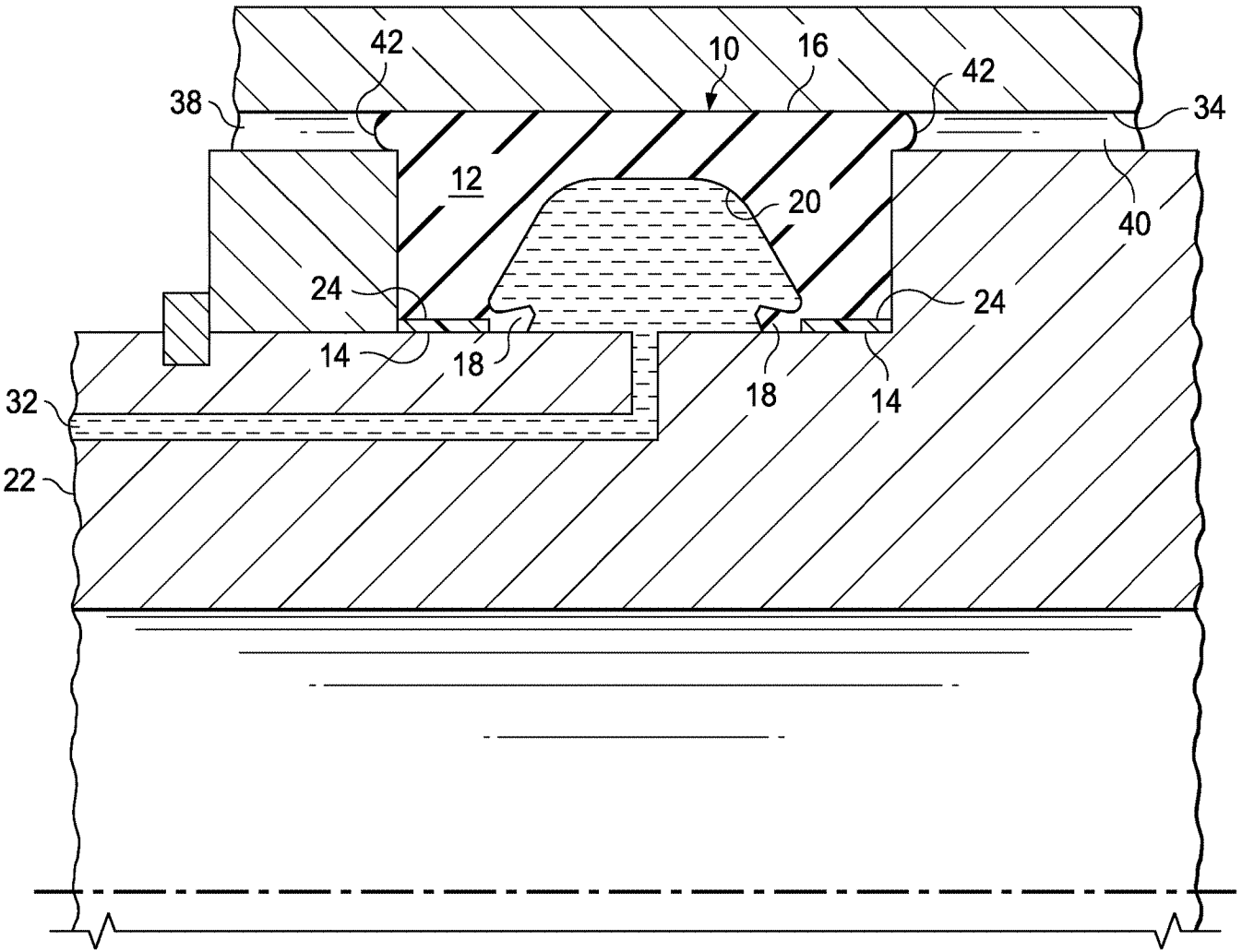
FIG. 3 is a cross-sectional view of the inflatable seal assembly shown in FIG. 2 installed on a stabbing mandrel and in the condition in which an inflatable elastomeric section has been inflated.

Referring now to FIG. 3, when the sealing ring 10 is pressurized, fluid pressure is delivered from the passage 32 to the inner cavity 20 and is sealably trapped within the inner cavity 20 by the sealing lip portions 18. Also, upon pressurization, the elastomeric body 12 expands radially outward to sealably contact the receiving bore 34 of surrounding hardware. The high modulus reinforcing material that is integrally bonded with the elastomeric body 12 keeps the sealing lip portions 18 and the base portions 24 of the inner diameter side 14 of the elastomeric body 12 in contact with the stabbing mandrel 22, especially when pressure is low and the pressure acting on the sealing lip portions 18 is insufficient to overcome the tension from the inflatable elastomeric body 12. With the internal fluid pressure from passage 32 radially expanding the elastomeric body 12 so that the outer diameter side 16 engages the receiving bore 34, fluid pressure in annuli 38,40 formed between the stabbing mandrel 22 and the receiving bore 34 cannot pass the sealing ring 10 unless the annuli pressure exceeds the fluid pressure in the internal cavity 20.

With further reference to FIG. 3, when the sealing ring 10 is pressurized, fluid pressure delivered from the passage 32 to the inner cavity 20 causes the inflatable elastomeric body 12 to expand, such that portions 42 move into the annuli 38,40.

With continuing reference to FIG. 3, upon pressurization, the outer diameter side 16 of the sealing ring 10 expands to meet the receiving bore 34. Typically the receiving bore 34 has approximately a ¼ inch of diametrical clearance with the sealing ring 10 so the radial distance travelled by the expanding sealing ring 10 is about ⅛ of an inch. Without the high modulus reinforcing material, a substantial void would form behind the sealing lip portions 18 of the inner diameter end 14 of the elastomeric body 12. As a result, the sealing lip portions 18 would tend to break sealable contact with the stabbing mandrel 22, especially at lower pressures when the pressure exerted on the sealing lip portions 18 is not sufficient to overcome the tension from the inflatable elastomeric body 12. This is caused by the tension from the inflatable elastomeric body 12 lifting the sealing lip portions 18 away from the stabbing mandrel 22 before the internal fluid pressure in the cavity 20 can adequately force the sealing lip portions 18 into the stabbing mandrel 22. Even if the sealing lip portions 18 did maintain sealable contact with the stabbing mandrel 22 at lower pressures (below 100 psi), the high internal pressure (potentially thousands of pounds per square inch) in the cavity 20 could invert or blow out the sealing lip portions 18 into the void. According to several exemplary embodiments, the high modulus reinforcing material located at the base portions 24 adjacent the sealing lip portions 18 at the inner diameter end 14 of the sealing ring 10 assist the sealing lip portions 18 in maintaining contact with the stabbing mandrel 22 and also provide back-up support to keep the sealing lip portions 18 from blowing outward.

Figure 4:
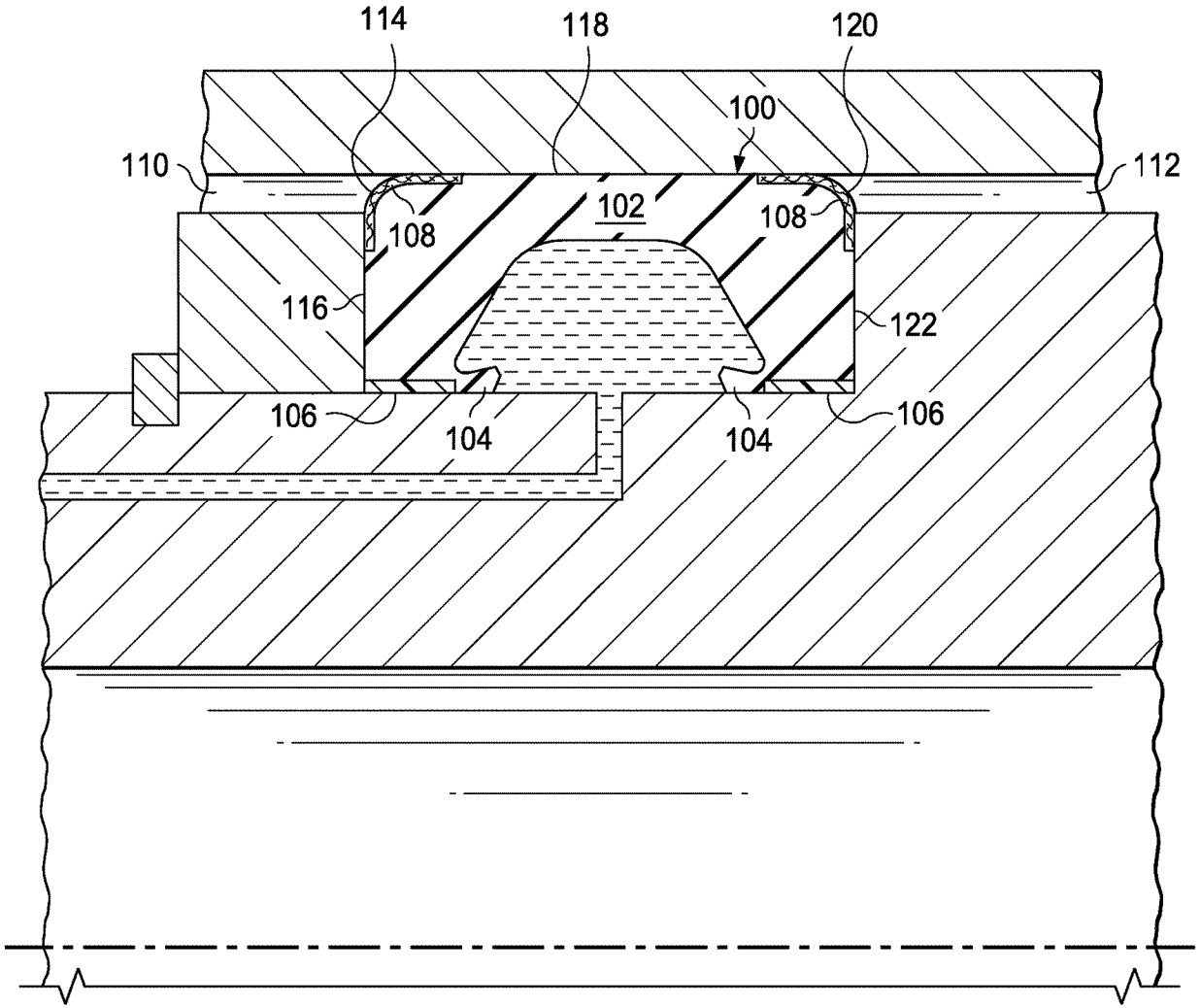
FIG. 4 is a cross-sectional view of an inflatable seal assembly similar to that shown in FIG. 1 with expandable fabric outer corners.

FIG. 4 shows a sealing ring 100 that is similar to the inflated sealing ring 10 shown in FIG. 3 but with the inclusion of fabric 108 supporting the elastomeric body 102 and preventing it from extruding into annuli 110,112. Specifically, the fabric 108 is located at a junction portion 114 between a side end 116 and the outer diameter side 118 of the elastomeric body 102 and at a junction portion 120 between a side end 122 and the outer diameter side 118 of the elastomeric body. According to several exemplary embodiments, the fabric 108 is allowed to stretch by either being composed of a low modulus material or oriented to allow expansion. This is in contrast to the high modulus reinforcing material 106 that is wrapped in hoop orientation to restrict expansion.

As can be readily seen from the foregoing, principles of the present invention provide an inflatable seal assembly that includes high modulus reinforcing material integrated with an elastomeric seal to restrict expansion of the inner diameter side of the elastomeric seal so that sealing contact is maintained on the inner diameter side of the elastomeric seal even after the seal is inflated and the outer diameter side of the elastomeric seal is expanded. The integration of high modulus reinforcing material as a composite with the elastomeric material eliminates stress concentrations that are present with an elastomeric seal having rigid metal end rings bonded to the elastomeric expandable seal.

As can also be readily seen from the foregoing, principles of the invention also provide an inflatable seal assembly that includes one or more layers of a calendared fabric material positioned on the inner diameter side of the seal. Adjacent to the layers of the calendared fabric material towards the interior of the seal are two opposing lips that diametrically interfere with a stabbing mandrel and form a sealed cavity within which auxiliary fluid pressure can be injected. The layers of calendared fabric material can be bonded to the elastomer with a calendared rolling process and then can be molecularly cured to the homogeneous body of the seal. The layers of the calendared fabric material have an improved bonded surface due to the high modulus fibers in the fabric, and upon inflation of the seal, the outward radial elastomeric section of the seal is free to expand.

According to several exemplary embodiments of the present invention, the inflatable seal assembly includes an elastomeric body that is free to deform during expansion without initiating high stresses at bonded radially extending surfaces. The interior sealing lips are kept tightly in contact with the stabbing mandrel to maintain the seal of the interior cavity seal during inflation.

According to several exemplary embodiments of the present invention, the inflatable seal assembly does not include a metal component in contact with the mandrel surfaces so that the possibility of damage to the stabbing mandrel or sealing bore during assembly or pressurization is avoided.

According to several exemplary embodiments of the present invention, the inflatable seal assembly includes calendared fabric that is fashioned on a bias that allows expansion. According to such embodiments, the fabric can be used as an anti-extrusion device. Also, according to several exemplary embodiments, fabric designed for expansion is molded within the exterior corners of the seal which can help prevent extrusion after the seal is inflated.

The foregoing detailed description is to be clearly understood as being given by way of illustration and example only, the spirit and scope of the present invention being limited solely by the appended claims.

What is claimed is:

1. A sealing assembly, comprising:

a seal body having a generally C-shaped cross section, the seal body having an inner diameter end, an opposite outer diameter end, and first and second side ends;

wherein the seal body is formed of an inflatable elastomeric material having a first modulus;

wherein the inner diameter end of the seal body includes diametrically opposed first and second axially inward lip portions and diametrically opposed first and second axially outward base portions;

wherein the inner diameter end and the outer diameter end have approximately equal axial dimensions;

wherein each of the first and second side ends has a first end adjacent a corresponding one of the base portions of the inner diameter end of the seal body, and a second end adjacent the outer diameter end of the seal body;

wherein the seal body defines an inner region into which fluid pressure is adapted to be delivered to inflate the inflatable elastomeric material having the first modulus;

wherein an interface boundary is defined between the seal body and the inner region;

wherein the first lip portion has a radially-extending first surface and the second lip portion has a radially-extending first surface, the radially-extending first surfaces of the first and second lip portions are axially spaced from each other in a parallel relation and the interface boundary extends in a continuous manner from the first surface of the first lip portion to the first surface of the second lip portion;

wherein the inflatable elastomeric material having the first modulus, and the inner region, together define the generally C-shaped cross section of the sea body;

wherein the inflatable elastomeric material having the first modulus extends uninterruptedly throughout the generally C-shaped cross section of the seal body;

wherein, due to the uninterrupted extension of the inflatable elastomeric material throughout the generally C-shaped cross section of the seal body, the inflatable elastomeric material having the first modulus extends uninterruptedly along the interface boundary in its entirety between the seal body and the inner region, and thus the inflatable elastomeric material having the first modulus is adjacent the inner region along the interface boundary in its entirety between the seal body and the inner region;

wherein the diametrically opposed first and second axially outward base portions include first and second recesses, respectively, formed in the seal body, each of the first and second recesses defining a radially-extending surface and an axially-extending surface;

wherein the first and second recesses are axially spaced from each other;

wherein the respective radially-extending surfaces of the first and second recesses are axially spaced from each other in a parallel relation;

wherein the respective axially-extending surfaces of the first and second recesses are axially spaced from each other and are coaxial with each other;

wherein the axially-extending surface defined by the first recess extends from the radially-extending surface defined by the first recess to the first end of the first side end, and thus the axially-extending surface defined by the first recess is adjacent the first end of the first side end; and wherein the axially-extending surface defined by the second recess extends from the radially-extending surface defined by the second recess to the first end of the second side end, and thus the axially-extending surface defined by the second recess is adjacent the first end of the second side end;

a first layer of reinforcing material integrally molded to the seal body at the first axially outward base portion;

wherein the first layer of reinforcing material has a second modulus that is higher than the first modulus;

wherein the first layer of reinforcing material is disposed within the first recess;

wherein the first layer of reinforcing material extends from the radially-extending surface defined by the first recess to the first end of the first side end of the seal body;

wherein the first layer of reinforcing material defines:

first and second faces spaced axially and in a parallel relation; and first and second surfaces spaced radially and in a concentric relation;

wherein each of the first and second surfaces of the first layer of reinforcing material extends from the first face of the first layer of reinforcing material to the second face of the first layer of reinforcing material;

wherein the first face defined by the first layer of reinforcing material is approximately axially aligned with the first side end of the seal body;

wherein the second face defined by the first layer of reinforcing material contacts the radially-extending surface defined by the first recess;

wherein the first surface of the first layer of reinforcing material contacts the axially-extending surface defined by the first recess; and wherein the second surface of the first layer of reinforcing material is radially positioned between the axially-extending surface defined by the first recess and at least a portion of the first axially inward lip portion of the seal body;

a second layer of reinforcing material integrally molded to the seal body at the second axially outward base portion;

wherein the second layer of reinforcing material has the second modulus;

wherein the second layer of reinforcing material is disposed within the second recess;

wherein the second layer of reinforcing material is axially spaced from the first layer of reinforcing material in a parallel relation;

wherein the second layer of reinforcing material extends from the radially-extending surface defined by the second recess to the first end of the second side end of the seal body;

wherein the second layer of reinforcing material defines:

first and second faces spaced axially and in a parallel relation; and first and second surfaces spaced radially and in a concentric relation;

wherein each of the first and second surfaces of the second layer of reinforcing material extends from the first face of the second layer of reinforcing material to the second face of the second layer of reinforcing material;

wherein the first face defined by the second layer of reinforcing material is approximately axially aligned with the second side end of the seal body;

wherein the second face defined by the second layer of reinforcing material contacts the radially-extending surface defined by the second recess;

wherein the first surface of the second layer of reinforcing material contacts the axially-extending surface defined by the second recess; and wherein the second surface of the second layer of reinforcing material is radially positioned between the axially-extending surface defined by the second recess and at least a portion of the second axially inward lip portion of the seal body.

* * * * *